US008393259B2

(12) United States Patent
Larue

(10) Patent No.: US 8,393,259 B2
(45) Date of Patent: Mar. 12, 2013

(54) FIREARM BARREL HAVING MULTIPLE PORTS AND PORT SELECTOR

(76) Inventor: Mark C. Larue, Leander, TX (US)

( * ) Notice: Subject to any disclaimer, the term of this patent is extended or adjusted under 35 U.S.C. 154(b) by 274 days.

(21) Appl. No.: 12/925,613

(22) Filed: Oct. 25, 2010

(65) Prior Publication Data

US 2012/0167756 A1 Jul. 5, 2012

Related U.S. Application Data

(60) Provisional application No. 61/279,817, filed on Oct. 26, 2009.

(51) Int. Cl.
*F41A 5/00* (2006.01)

(52) U.S. Cl. ..... 89/193

(58) Field of Classification Search ..... 89/193
See application file for complete search history.

(56) References Cited

U.S. PATENT DOCUMENTS 2,748,662 A * 6/1956 Simpson ..... 89/193
3,443,477 A * 5/1969 Kaempf ..... 89/128
7,934,447 B2 * 5/2011 Kuczynko et al. ..... 89/193

* cited by examiner

*Primary Examiner* — Benjamin P Lee
*Assistant Examiner* — Benjamin Gomberg
(74) *Attorney, Agent, or Firm* — James L. Jackson

(57) ABSTRACT

A cartridge gas port selector mechanism for a firearm barrel having a plurality of gas ports extending from the barrel bore and having a gas block with gas passages in communication with a gas tube. A selector valve member is movable within the gas block between an open condition permitting flow of cartridge gas from one or more ports of the firearm barrel to the cartridge gas passage and a closed condition blocking flow of cartridge gas from the barrel bore to the cartridge gas passage. A valve selector or actuator is connected with the valve member and is selectively moveable to position the valve member at the open condition or the closed condition to select the volume and timing of cartridge gas communication from the barrel bore to the gas energized autoloading mechanism of the firearm.

18 Claims, 5 Drawing Sheets

FIREARM BARREL HAVING MULTIPLE PORTS AND PORT SELECTOR

RELATED PROVISIONAL APPLICATION

Applicant hereby claims the benefit of U.S. Provisional Patent Application No. 61/279,817, filed on Oct. 26, 2009 by Mark C. LaRue and entitled "Firearm Barrel Having Multiple Ports and Port Selector".

BACKGROUND OF THE INVENTION

1. Field of the Invention

The present invention relates generally to tactical firearms that are utilized by tactical and special operations personnel for military and law enforcement activities, particularly cartridge gas operated firearms such as the military M-16 and the commercial AR-15. More particularly, the present invention concerns a firearm barrel assembly having multiple, i.e., two or more, gas ports in communication with the bore of the barrel, with at least one of the ports being controlled by a selector valve for selecting open and closed port valve positions. The port selector valve controllable multiple port gas system of the barrel permits reliable firearm operation to occur normally and when gas pressure changing devices such as suppressors are in gas receiving and bullet transmitting assembly with the firearm barrel.

2. Description of The Prior Art

To the knowledge of applicant most AR-15 and M-16 autoloading firearms incorporate a barrel to which various types of flash and noise suppressors may be attached. The barrel is provided with a gas block that is mounted to the barrel and has an internal gas passage that is in communication with a single gas port which is formed in the barrel and communicates with the barrel bore.

In the event of change of cartridge gas pressure or volume that enters the gas tube from the gas passage of the gas block and the port of the barrel it is possible for the firearm to fail to function properly. This condition is evidenced by failure of proper cartridge loading, cartridge hang-ups in the breach, failure to retrieve a cartridge from the magazine of the firearm, etc.

When a compensator or suppressor is attached to the forward end of a rifle barrel the result is a change of cartridge gas pressure conditions within the barrel bore and also a change of the timing sequence for cartridge gas pressure rearward actuation of the piston rod and the bolt that is actuated rearwardly by the piston rod. Thus, when a compensator or suppressor is attached to the barrel, the barrel bore pressure is lowered, thus causing a delay in piston movement and slower piston movement by the cartridge gas pressure. The bolt within the receiver is thus moved more slowly by the piston energized actuator rod so that the bolt may not be moved completely to the cartridge case ejecting position against the force of the bolt return spring. A cartridge case may be extracted from the cartridge chamber of the barrel and may be partially, but not completely ejected by the rearwardly moving bolt and may interfere with the subsequent spring energized forward bolt movement or a released cartridge case may interfere with the cartridge loading and bolt closing process of a firing cycle, thus potentially causing the cartridge handling mechanism to jam. When a jamming condition has occurred it is necessary to manually move the bolt rearwardly to eliminate the cartridge case jam and to ensure that a subsequent live cartridge is moved by the bolt from the cartridge magazine into the cartridge chamber of the barrel.

It is desirable therefore to provide for selective change of cartridge gas pressure or volume to the gas tube of the firearm to thus restore proper operation of the firearm in the event the use of a larger suppressor should cause improper firearm operation.

SUMMARY OF THE INVENTION

It is a primary feature of the present invention to provide a novel gas-operated firearm, such as an autoloading rifle having a novel barrel assembly having a cartridge gas port system that can be manually controlled to permit reliable operation of the firearm when cartridge gas pressure changing systems, such as flash or noise suppressors or other accessories, are mounted in gas receiving relation with the barrel of the firearm.

It is another feature of the present invention to provide a novel cartridge gas-operated firearm which may be simply and efficiently manually adjusted, even in field conditions or conditions of insufficient light by manual operation of a port selector so that two or more cartridge gas ports of the barrel may be simultaneously communicated with the gas tube of the firearm during firing conditions.

It is also a feature of the present invention to provide a novel cartridge gas-operated firearm having a plurality of cartridge gas ports in the barrel thereof and employing a selector valve mechanism for simply and efficiently selecting one or more of the cartridge gas ports for communication with the bolt operating mechanism of the firearm.

Other and further objects and features of the present invention will become apparent to one skilled in the art upon a thorough review of the apparatus and method that is disclosed herein.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

IN THE DRAWINGS

Figure 1:
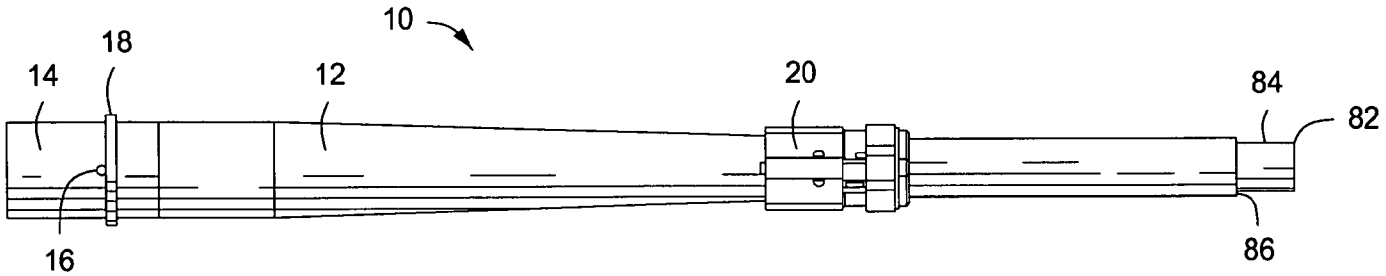
Figure 2:
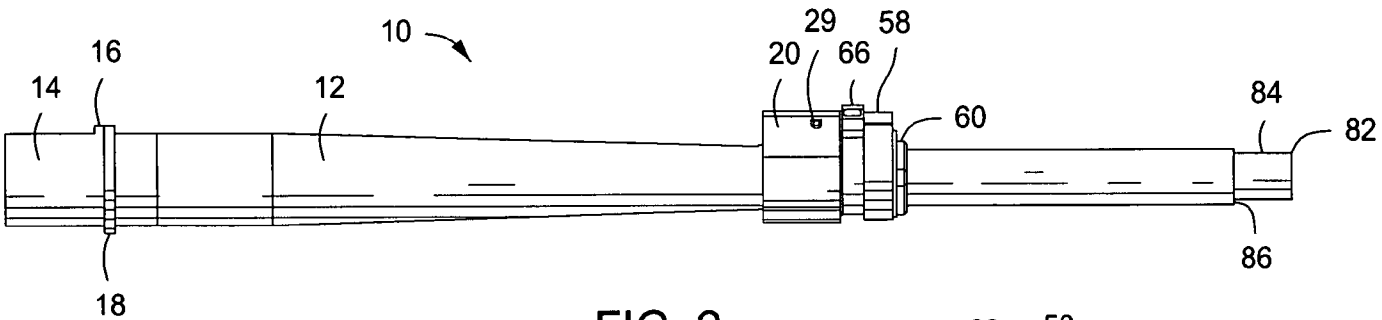
Figure 2A:
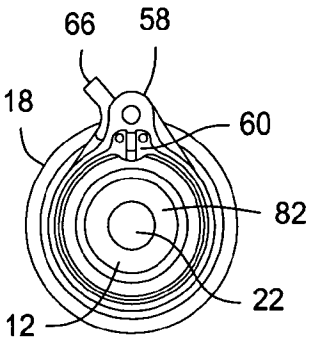
Figure 3:
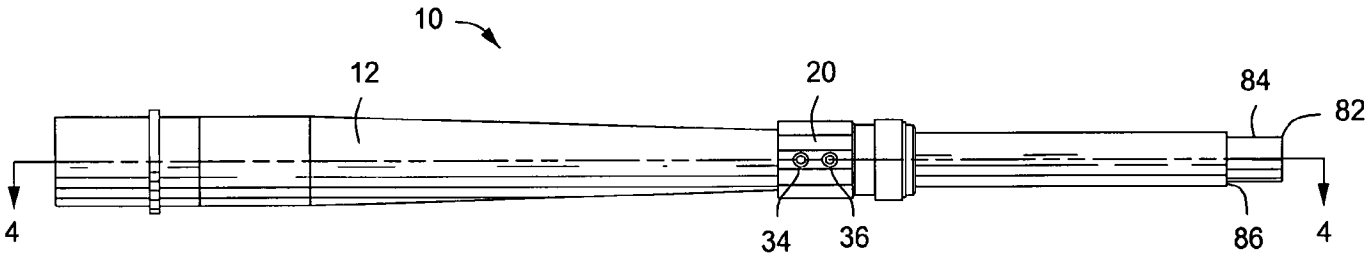
Figure 4:
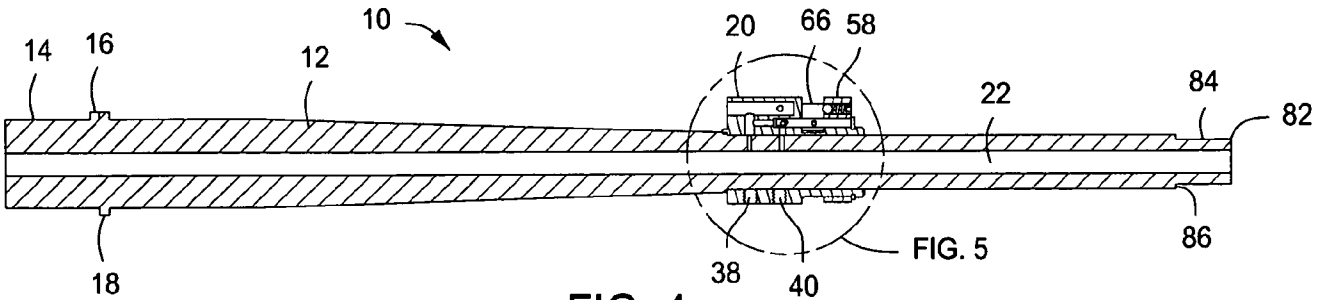
Figure 5:
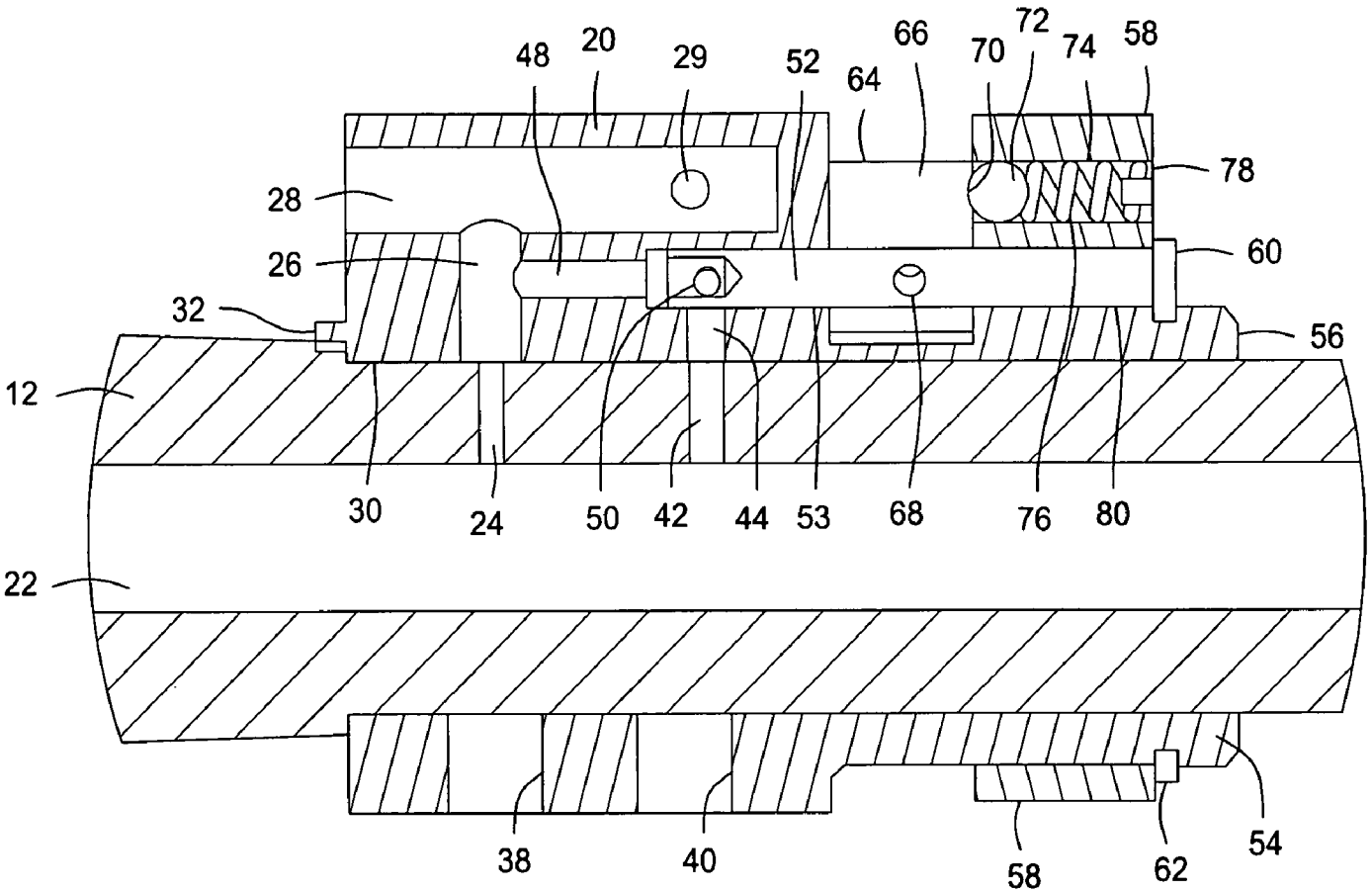
Figure 5A:
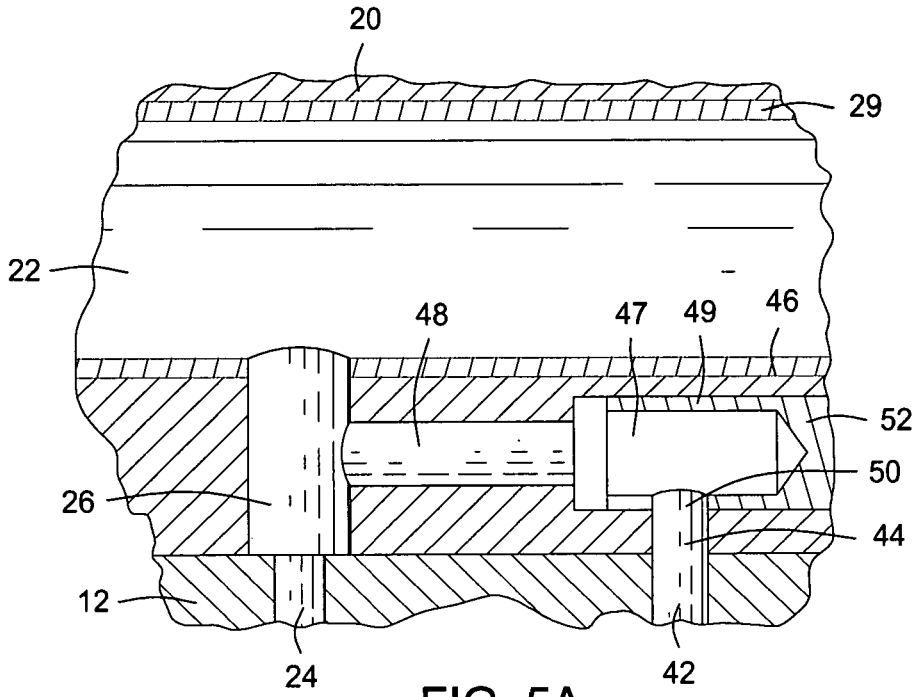
Figure 5B:
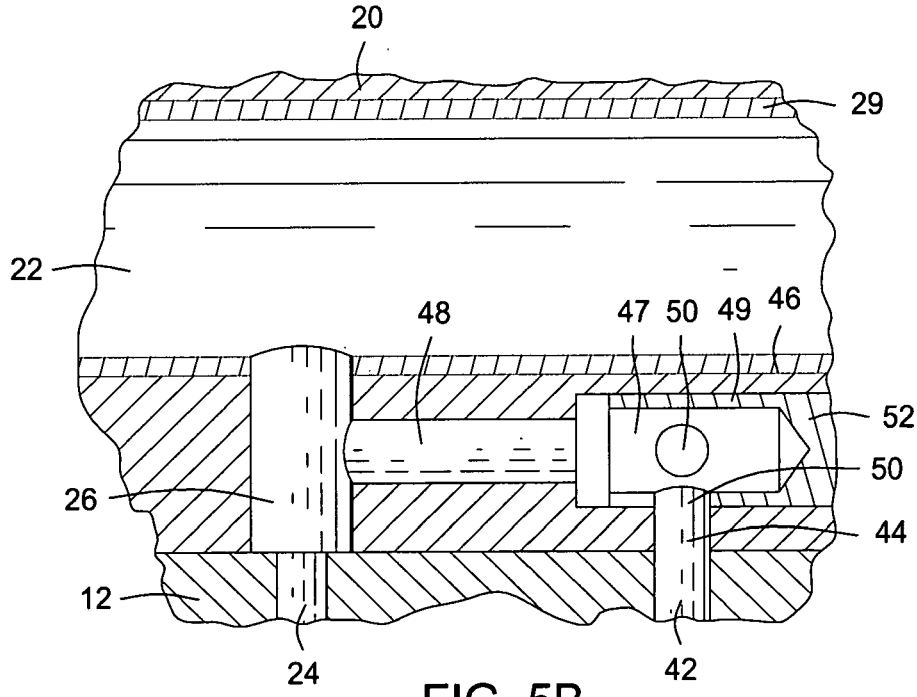
Figure 6:
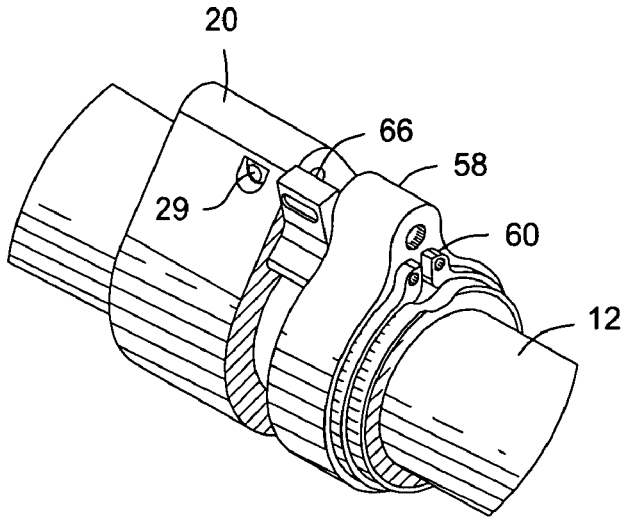
Figure 7:
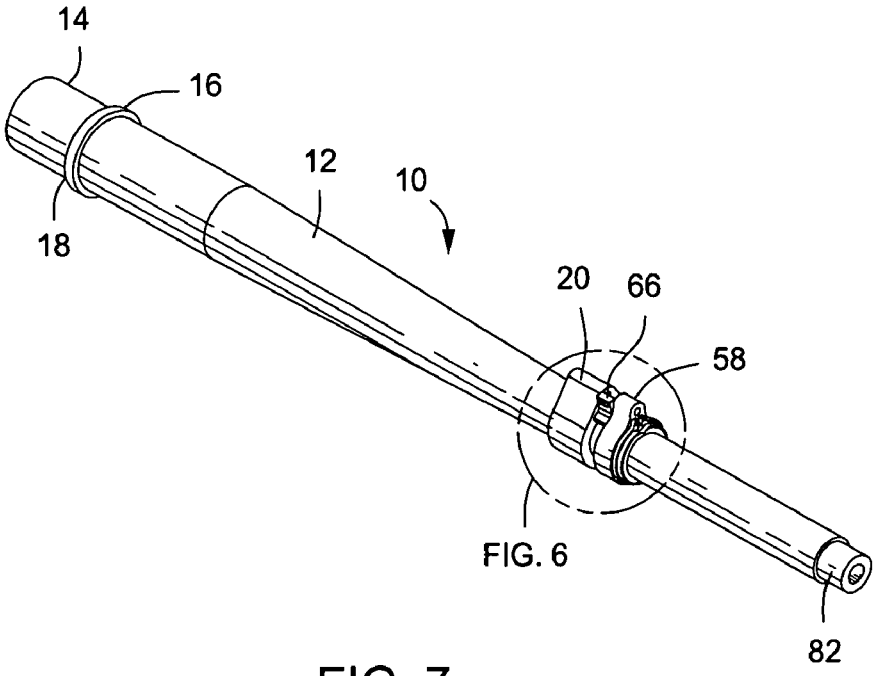

FIG. 1 is a top view of a barrel assembly for an AR-15 type rifle, showing a gas block assembly thereof;

FIG. 2 is a side elevation view of the barrel assembly of FIG. 1;

FIG. 2*a* is an end view taken along line 2*a*-2*a* of FIG. 2;

FIG. 3 is a bottom view of the barrel assembly of FIGS. 1 and 2;

FIG. 4 is a longitudinal section view of the barrel assembly of FIGS. 1-3, showing the firearm barrel to have two gas ports and having a gas block assembly with a selector mechanism permitting selective manually controlled opening and closing of one of the gas ports;

FIG. 5 is a partial longitudinal sectional view showing the gas block assembly and manually controlled port selector mechanism in greater detail;

FIG. 5*a* is a fragmentary sectional view of portions of the barrel, gas block and port selector mechanism of FIG. 5, showing the open position of the port selector valve member;

FIG. 5*b* is a fragmentary sectional view similar to FIG. 5*a*, showing the closed position of the port selector valve member;

FIG. 6 an isometric illustration showing a part of the firearm barrel and showing gas block assembly and manually controlled port selector mechanism of the firearm barrel assembly; and FIG. 7 is an isometric illustration showing the firearm barrel and showing the gas block assembly and manually controlled port selector mechanism of the firearm barrel assembly.

DETAILED DESCRIPTION OF PREFERRED EMBODIMENT

Referring now to the drawings and first to FIGS. 1-4 there is shown a firearm barrel assembly generally at 10 having a barrel 12 that is provided with a barrel extension 14 having an indexing pin 16 that engages within an indexing receptacle of an upper receiver and precisely orients the firearm barrel with respect to the upper receiver. The barrel is provided with a circular retainer flange 18 that is engaged by a barrel nut to retain the barrel assembly in fixed and properly oriented relation with a conventional upper receiver.

At a desired location along the length of the barrel 12 a gas block 20 embodying the principles of the present invention is mounted to the barrel. As shown in the longitudinal section view of FIG. 4 and in greater detail in the longitudinal section view of FIG. 5 the barrel 12 defines a bore 22, typically a rifled bore. Conventionally, for cartridge gas operation a single gas port 24 communicates the bore 22 with a passage 26 of the gas block 20 which in turn is in communication with a gas tube passage 28. A conventional gas tube 31 has an end portion thereof located in sealed relation within the gas tube passage and defines a gas passage 33 that serves to conduct the cartridge gas pressure to a bolt actuating mechanism of the firearm after a bullet has moved past the gas port 24 for the purpose of driving the bolt rearwardly against the force of a bolt return spring to eject a spent cartridge case and to prepare the bolt mechanism for moving a fresh cartridge from a cartridge magazine into the cartridge chamber of the barrel. The gas tube 31 is secured within the gas tube passage 28 by a gas tube retainer 29 that extends through aligned retainer openings in the gas block 20 and gas tube 31.

The barrel 20 of the firearm is machined to define a reduced diameter section 25 about which the gas block 20 is received. The barrel structure is also machined to define a gas block orienting or indexing receptacle 30 which is precisely oriented with respect to the indexing pin 16 of the barrel 12. The gas block orienting receptacle 30 is engaged by an indexing member 32 of the gas block 20 for precisely orienting the gas block 20 relative to the indexing features of the firearm barrel and to orient the gas tube passage 28 for receiving the gas tube 29 of the firearm. Set screws 34 and 36 are received within internally threaded set screw openings 38 and 40 of the gas block 20 and are seated and tightened to engage the reduced diameter section 25 of the barrel 12 and retain the gas block 20 in substantially immovable relation with the barrel.

According to the principles of the present invention at least a second cartridge gas port 42 is formed in the barrel 12 in communication with the bore 22 and is also in communication with a gas passage 44 of the gas block 20. The gas passage 44 intersects a selector or valve passage 46 of the gas block 20 and is in selective communication with a lateral gas passage 48 of the gas block via a valve opening 50 that is defined in a rotatable selector pin 52 that has a portion thereof rotatably positioned within the selector pin or valve passage 46 of the gas block 20. Although two cartridge gas ports 24 and 42 are shown, it is to be borne in mind that additional controllable gas ports may also be provided in the barrel and gas block or in an additional gas block without departing from the spirit and scope of the present invention. Each of the valve controlled cartridge gas ports is either open or closed, depending on the rotary position of the rotatable selector pin or valve 52. Cartridge gas pressure communication of the controllable gas port 42 with the gas tube passage 28 is controlled by selective rotation of the rotatable selector pin or valve member 52 which has open and closed positions within the selector pin passage 53.

The open and closed valve operating activity of the cartridge gas controlling mechanism may include any mechanism for blocking one or more of the gas block passages that are in communication with one or more of the gas ports of the firearm barrel while at least one of the gas ports remains open. According to the preferred embodiment of this invention, as shown in the sectional view of FIG. 5 and the fragmentary sectional views of FIGS. 5*a* and 5*b*, the rotatable selector pin or valve 52 is drilled or otherwise machined at its inner end to define an axial valve passage 47 and a cylindrical valve wall 49. The valve opening 50 is formed in the cylindrical valve wall 49 and is in cartridge gas communication with the gas passage 44 of the gas block 20 at the open position shown in FIG. 5*a*. The cylindrical valve wall 49 blocks cartridge gas communication of the gas passage 44 of the gas block 20 with the second cartridge gas port 42 when the rotatable selector pin or valve 52 has been rotated to its closed position as shown in FIG. 5*b*.

Although the selector pin or valve member 52 is shown to be moved rotationally between its open and closed positions, it should be borne in mind that the selector pin may be moved linearly between its open and closed positions if desired. Thus, when the valve member is described herein as being moved to its open or closed position, such movement may be either rotary or linear movement or a combination thereof without departing from the spirit and scope of the present invention.

It is necessary, according to the teachings of the present invention that a valve member have an open position permitting communication of cartridge gas from one of a plurality of cartridge gas ports of a firearm barrel to the gas operating system of an autoloading firearm and a closed position preventing such cartridge gas communication. The valve controlled plural gas port features of the present invention effectively distinguishes the present invention from prior art cartridge gas regulator mechanisms that permit adjustment of cartridge gas pressure from a single gas port of the firearm barrel. This feature permits the user of the firearm to achieve proper operation of the cartridge gas energized autoloading system of a firearm when a barrel attachment, such as a compensator or suppressor, is mounted to the firearm barrel and changes the cartridge gas pressure and timing sequence of the cartridge gas that is communicated from the bore of the firearm barrel to the gas passages of the gas block. Thus, even in field conditions the user of a cartridge gas energized autoloading firearm can quickly assemble a compensator to the barrel of the firearm and manually move a selector member to a position changing the effective gas port dimension of the firearm barrel bore to achieve proper gas energized operation of the firearm.

It is desirable to provide for manual rotatable positioning control of the selector pin 52 and to also provide for simple and efficient manual rotatable positioning of the selector pin. It is also desirable to provide a visual reference or a reference that can be identified by feel during darkness or during conditions of poor light. These features are efficiently accomplished by means of a manually operable selector element that indicates the open and closed conditions of the rotatable selector pin both visually and by manual feel. The gas block 20 is provided with a lateral selector extension 54 which is machined to define an oriented receptacle or seat 56 for a selector detent mount 58 to establish a spaced and non-rotatable relationship of the selector detent mount with respect to the gas block 20. The selector detent mount 58 is retained against axial movement relative to the gas block by means of a retainer spring 60 which is received within a circular spring groove 62 of the lateral selector extension 54.

In a substantially annular recess 64 between the gas block 20 and the selector detent mount 58 is movably located a port selector actuator member 66 which is fixed to the selector pin 52 by a retainer pin 68. Thus selective manual rotation of the port selector actuator member 66 achieves actuating rotation of the selector pin 52 to its open and closed positions permitting cartridge gas communication via one or both of the cartridge gas ports 24 and 42 depending on the position of the port selector actuator member 66 within the recess 64. To ensure maintenance of the port selector actuator member 66 at its open or closed positions a detent recess 70 in the port selector actuator member 66 is engaged by a detent member 72 that is moveable with a detent and spring passage 74. The detent member 72 is urged into the detent recess 70 by a compression spring 76 or by any other suitable means. The compression spring is secured within the detent passage 74 by an adjustable spring retainer member 78 that is threaded within the detent and spring passage 74. The selector detent mount 58 also defines a passage 80 which is aligned with the selector pin passage 53 and provides rotatable bearing support for a portion of the selector pin 52.

The barrel defines a muzzle section 82 which is typically of reduced diameter to provide a cylindrical, typically externally threaded receiver 84 and a circular shoulder 86 and providing for attachment of a flash suppressor, noise suppressor or other accessory to the barrel. Firearm flash suppressors are provided in a wide variety of sizes depending on the needs of the user. Flash suppressors receive a portion of the cartridge gas as the bullet clears the muzzle of the barrel and proceeds through the internal chamber of the flash suppressor. Flash or noise suppressors also change the pressure and thus the volume of cartridge gas that is conducted to the bolt mechanism by the gas tube of the firearm. The port selector mechanism of the present invention permits the user of the firearm to manually adjust the volume of cartridge gas by manual manipulation of the selector mechanism so that cartridge gas is permitted access to the gas tube via one or more of the gas ports of the barrel.

OPERATION: Assuming the barrel 12 of the firearm has no flash or noise suppressor or has a small suppressor device mounted thereto, the port selector actuator member 66 may be positioned at its closed setting so that only the cartridge gas port of the firearm barrel is open. At this position the port selector actuator member 66 will position the selector pin 52 with its valve opening 50 oriented out of registry with the gas passage 44 and gas port 42 thus blocking communication of the cartridge gas with the lateral gas passage 48 of the gas block. In this selected position only the cartridge gas that enters the gas tube passage 28 from the gas port 24 will be in communication with the gas tube.

Assuming that a larger flash or noise suppressor is substituted for the smaller suppressor, the resulting cartridge gas pressure change reaching the gas tube may be insufficient for proper operation of the cartridge autoloading mechanism of the firearm, thus causing cartridge hang-ups, improper feeding from the cartridge magazine, etc. To correct this undesirable condition the user of the firearm will simply manually move the port selector member 66 to its open position, thereby rotating the selector pin 52 to the open position where the valve opening 50 is open to the gas passage 44 and gas port 42. To accomplish this opening movement it is necessary to apply sufficient manual force to the port selector member 66 to move the detent member 72 out of its detent recess 70 by means of the camming activity of the tapered surface of the detent recess. When this operation has been done, the cartridge gas of the bore will enter the gas tube from both of the gas ports 24 and 42 by virtue of the open condition of the port selector mechanism. The user of the firearm is thus enabled to quickly and efficiently change out flash or noise suppressors or other firearm barrel accessories within a few minutes time and in the field and to quickly and efficiently adjust cartridge gas pressure and/or volume to ensure proper operation of the firearm.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A cartridge gas selector mechanism for a firearm barrel of a selected length having a bore extending therethrough;

a gas block mounted to said firearm barrel and defining a cartridge gas passage;

said firearm barrel defining primary and secondary cartridge gas ports located intermediate said selected length of said firearm barrel and communicating said bore with said cartridge gas passage, said primary cartridge gas port being open at all times; and a selector valve member being movable within said gas block between an open condition permitting flow of cartridge gas from said bore through said secondary cartridge gas port to said cartridge gas passage and a closed condition blocking flow of cartridge gas from said bore through said secondary cartridge gas port to said cartridge gas passage.

2. The cartridge gas selector mechanism of claim 1 comprising:

a selector valve actuator engaging said selector valve member and being moveable to position said selector valve member at said open condition and said closed condition.

3. The cartridge gas selector mechanism of claim 1, comprising:

a retainer member retaining said selector valve actuator against inadvertent movement from said open condition and said closed condition.

4. The cartridge gas selector mechanism of claim 1, comprising:

a gas tube having an end portion secured within said cartridge gas passage and communicating cartridge gas pressure to a receiver of the firearm for cartridge ejection and loading during firearm use;

said gas block defining a selector valve passage with which said secondary gas port is communicated; and said selector valve member having a portion thereof being located within said selector valve passage and having a valve port being in registry with said secondary gas port at said open condition of said valve member and having a blocking portion closing said secondary gas port at said closed condition of said selector valve member.

5. The cartridge gas selector mechanism of claim 1, comprising:

said selector valve member having a valve wall structure defining a valve passage open at one end of said selector valve member and defining a valve opening in communication with said valve passage, said selector valve member being movable to an open position where said valve opening is in registry with said secondary gas port and being movable to a closed position where said valve wall structure blocks communication of said secondary cartridge gas port with said cartridge gas passage.

6. The cartridge gas selector mechanism of claim 1, comprising:

a selector valve receptacle being defined by said gas block and being in communication with said cartridge gas passage; and said selector valve member having a portion thereof movably located within said selector valve receptacle and having a valve opening communicating said secondary gas port with said cartridge gas passage at said open condition of said selector valve member and having a blocking portion closing communication of said secondary gas port with said cartridge gas passage at said closed condition of said selector valve member.

7. The cartridge gas selector mechanism of claim 6, comprising:

said selector valve member being rotatably moveable to said open and closed conditions.

8. The cartridge gas selector mechanism of claim 7, comprising:

a portion of said selector valve member being located externally of said gas block;

an actuator member being fixed to said selector valve member and being positioned for selective manual movement of said selector valve member to said open and closed conditions.

9. The cartridge gas selector mechanism of claim 1, comprising:

a selector valve actuator member being mounted to said valve member and defining retainer recesses;

a retainer member being mounted to said gas block and defining a detent and spring receptacle;

a detent member being moveable within said detent and spring receptacle and being disposed for retaining engagement with said retainer recesses and releasably maintaining said retainer member against inadvertent movement from said open and closed positions thereof; and a spring member being located within said detent and spring receptacle and urging said detent member into said retainer recesses.

10. A cartridge gas selector mechanism for a firearm comprising:

a firearm barrel having a bore extending therethrough and having primary and secondary cartridge gas ports, said primary cartridge gas port being open at all times and communicating cartridge gas pressure from said bore;

a gas block mounted to said firearm barrel and defining a cartridge gas passage being in communication with said primary cartridge gas port;

a valve receptacle being defined within said gas block and being in valve controlled communication with said cartridge gas passage and with said secondary cartridge gas port a selector valve member being movable within said valve receptacle of said gas block and being moveable between an open condition permitting flow of cartridge gas from said bore through said secondary cartridge gas port to said cartridge gas passage and a closed condition blocking flow of cartridge gas from said bore through said secondary cartridge gas port to said cartridge gas passage.

11. The cartridge gas selector mechanism of claim 10 comprising:

a selector valve actuator being moveable to position said selector valve member at said open condition and said closed condition.

12. The cartridge gas selector mechanism of claim 11, comprising:

a retainer member retaining said selector valve actuator against inadvertent movement from said open condition and said closed condition.

13. The cartridge gas selector mechanism of claim 10, comprising:

a gas tube having an end portion secured within said cartridge gas passage and communicating cartridge gas pressure to a receiver of the firearm for cartridge ejection and loading during firearm use;

said gas block defining a selector valve passage with which said secondary gas port is communicated; and said selector valve member having a portion thereof being located within said selector valve passage and having a valve port being in registry with said secondary gas port at said open condition of said valve member and having a blocking portion closing said secondary gas port at said closed condition of said selector valve member.

14. The cartridge gas selector mechanism of claim 10, comprising:

said selector valve member having a valve wall structure defining a valve passage open at one end of said selector valve member and defining a valve opening in communication with said valve passage, said selector valve member being movable to an open position where said valve opening is in registry with said secondary gas port and being movable to a closed position where said valve wall structure blocks communication of said secondary cartridge gas port with said cartridge gas passage.

15. The cartridge gas selector mechanism of claim 10, comprising:

a selector valve receptacle being defined by said gas block and being in communication with said cartridge gas passage;

said selector valve member having a portion thereof movably located within said selector valve receptacle and having a valve opening communicating said secondary gas port with said cartridge gas passage at said open condition of said selector valve member and having a blocking portion closing communication of said secondary gas port with said cartridge gas passage at said closed condition of said selector valve member; and said selector valve member being rotatably moveable to said open and closed conditions.

16. The cartridge gas selector mechanism of claim 15, comprising:

a portion of said selector valve member being located externally of said gas block;

an actuator member being fixed to said selector valve member and being positioned for selective manual movement of said selector valve member to said open and closed conditions.

17. A cartridge gas selector mechanism for a firearm comprising:

a firearm barrel having a bore extending therethrough and having primary and secondary cartridge gas ports, said primary cartridge gas port being open at all times and communicating cartridge gas pressure from said bore;

a gas block mounted to said firearm barrel and defining a cartridge gas passage being in communication with said primary cartridge gas port;

a port selector receptacle being defined within said gas block and being in controlled communication with said cartridge gas passage and with said secondary cartridge gas port;

a port selector member being movable within said valve receptacle of said gas block and being moveable between an open position permitting flow of cartridge gas from said bore through said secondary cartridge gas port to said cartridge gas passage and a closed position blocking flow of cartridge gas from said bore through said secondary cartridge gas port to said cartridge gas passage;

an actuator member being mounted to said port selector member and permitting manually controlled positioning of said port selector member at said open and closed positions; and a retainer member having position retaining relation with said actuator member and maintaining said actuator member against inadvertent movement from said open position and said closed position.

18. The cartridge gas selector mechanism of claim 17, comprising:

a selector valve receptacle being defined by said gas block and being in communication with said cartridge gas passage;

said selector valve member having a portion thereof movably located within said selector valve receptacle and having a valve opening communicating said secondary gas port with said cartridge gas passage at said open condition of said selector valve member and having a blocking portion closing communication of said secondary gas port with said cartridge gas passage at said closed condition of said selector valve member; and said selector valve member being rotatably moveable to said open and closed conditions.

* * * * *